US006637628B2

(12) United States Patent
Höser

(10) Patent No.: US 6,637,628 B2
(45) Date of Patent: Oct. 28, 2003

(54) LIQUID CONTAINER WITH CLOSURE

(75) Inventor: Jürgen Höser, Neu-Anspach (DE)

(73) Assignee: Braun GmbH (DE)

( * ) Notice: Subject to any disclaimer, the term of this patent is extended or adjusted under 35 U.S.C. 154(b) by 0 days.

(21) Appl. No.: 10/183,877

(22) Filed: Jun. 25, 2002

(65) Prior Publication Data

US 2002/0190088 A1 Dec. 19, 2002

Related U.S. Application Data

(63) Continuation of application No. PCT/EP00/10291, filed on Oct. 19, 2000.

(30) Foreign Application Priority Data

Apr. 15, 2000 (DE) ..... 100 01 454

(51) Int. Cl.[7] ..... B67D 3/00

(52) U.S. Cl. ..... 222/484; 222/457; 220/831; 220/837; 220/255; 137/576

(58) Field of Search ..... 222/556, 517, 222/498, 478, 481, 482, 484, 485, 487, 189.06, 130, 457; 220/831, 832, 833, 834, 837, 838, 255; 137/453, 571, 573, 574, 576

(56) References Cited

U.S. PATENT DOCUMENTS

| | | | | |
|---|---|---|---|---|
| 1,364,692 A | * | 1/1921 | Bomboy | 222/585 |
| 2,655,282 A | | 10/1953 | Dunbar | |
| 3,381,875 A | * | 5/1968 | Tunick | 229/120.03 |
| 4,291,818 A | | 9/1981 | Nozawa et al. | |
| 4,358,032 A | * | 11/1982 | Libit | 222/498 |
| 4,717,018 A | * | 1/1988 | Sacherer et al. | 206/305 |
| 4,723,693 A | * | 2/1988 | DeCoster | 222/483 |
| 5,579,957 A | | 12/1996 | Gentile et al. | |
| 5,897,036 A | * | 4/1999 | DeCoster et al. | 222/480 |
| 6,412,637 B1 | * | 7/2002 | Saunders et al. | 206/541 |

FOREIGN PATENT DOCUMENTS

| | | |
|---|---|---|
| DE | 3208994 A1 | 9/1983 |
| EP | 0 869 075 A1 | 10/1998 |
| GB | 2302857 A | 2/1997 |

* cited by examiner

*Primary Examiner*—Kevin Shaver
*Assistant Examiner*—Stephanie Willatt
(74) *Attorney, Agent, or Firm*—Fish & Richardson PC

(57) ABSTRACT

A liquid container with at least one opening and a closure having a graspable lug for opening the closure. The closure includes at least one lever arm for controlling the opening operation, with the lever arm's free end bearing against a the container during the opening operation.

15 Claims, 3 Drawing Sheets

Fig. 1
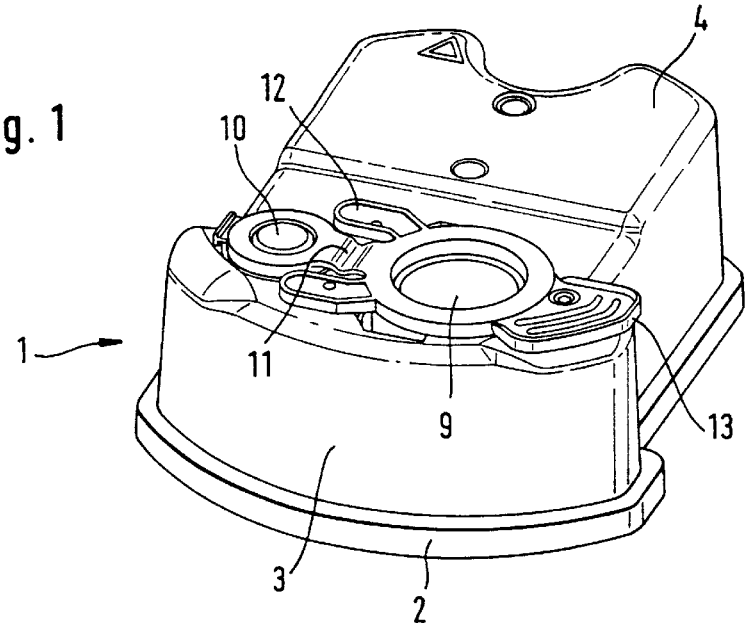
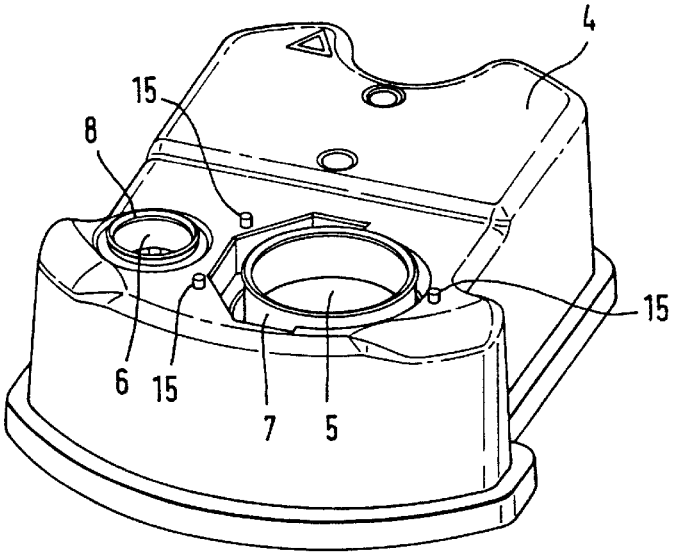
Fig. 2
Fig. 3
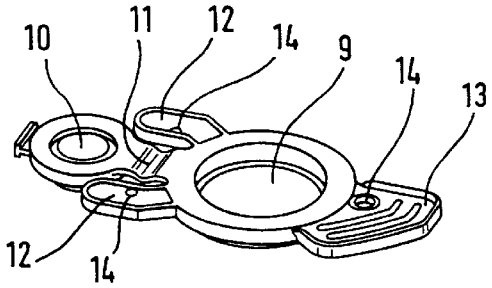

LIQUID CONTAINER WITH CLOSURE

This Application is a Continuation of PCT/EP00/10291 filed Oct. 19, 2000.

This invention relates to a container, in particular a liquid container.

BACKGROUND

Containers are used for storing or transporting piece goods, dry loose materials or liquids, as applicable with a pressure above or below atmospheric inside the container. Such a container is known from DE 42 22 396 C2, for example, whose edge zone is encompassed circumferentially by the edge section of the closure, the closure being equipped for this purpose with a circumferential groove in which the edge zone of the container engages in a closed state. To be opened the closure is equipped with a lug with which it may be gripped by the user.

Braun's "clean & charge" cleaning device is provided with a replaceable cartridge containing liquid, which has two openings closed by two interconnected closures (see directions for use 5-301-080/00/x-99). To open the closures there is a loop-type lug with which the closures may be torn open one after the other.

With containers of this type the progress of the opening operation depends entirely on the individual dexterity of the user, with the result that tearing open the closure too vigorously, for example, may cause the contents of the container to be spilled out, particular when there is liquid in the container.

It is therefore an object of the present invention to provide a liquid container, which ensures a controlled and in particular slow opening of the closure regardless of the user's individual dexterity and strength.

SUMMARY OF THE INVENTION

Through the combination of container and closure described herein the user is guided in self-explanatory manner through the opening operation, resulting in a controlled and slow opening of the closure with little expenditure of force. Given a suitable geometric configuration of the closure plus lever and lug it is possible, under controlled conditions and with little force, to open even a closure seated with a high sealing force in the container opening. The invention also prevents the closure springing away from the container, which may cause material sticking to the closure to be flung off unintentionally. This applies in particular to liquid or dust particles adhering to the closure, which may then cause splashes or dust deposits. Moving the lug causes the lever arm to engage and initiates and controls the opening operation of the closure.

In a practice-oriented embodiment of the invention which is particularly suitable for large series, provision is made for the lever arm to extend from the lug toward the closure, with the free end of the lever arm pointing away from the lug. Such a closure may be constructed so that it extends essentially in one plane and is easy to manufacture with little effort.

Particularly exact controlling of the opening operation is made possible by an embodiment of the invention which provides for a joint between the lever arm and the closure, with the axis of rotation of the joint and the pivot axis of the lever arm being parallel to each other.

Particularly exact controlling of the opening operation is made possible by an embodiment which provides for a joint between the lever arm and the closure, with the axis of rotation of the joint and the pivot axis of the lever arm being parallel to each other.

A further embodiment of the invention provides for the openings of the container to have cross sections of various size, in which case the container may have several compartments, each assigned a respective opening. Such an embodiment enables the separation of various materials stored in one container, particularly when the container compartments are separated from each other.

A further aspect of this embodiment in which the container compartments are interconnected is of advantage in particular for the storage of circulating operating, lubricating or cleaning agents, in which case one opening is connected to an inlet and the other opening to an outlet. The connection between the individual container compartments may take the form of cooling, heating, throttling, cleaning and/or sedimentation sections or the like, for example.

If in such an embodiment the container's contents are stored under a differential pressure relative to the atmosphere, it is an advantage for the opening with a first closure to be assigned to the compartment having a smaller air volume above a liquid level, and for the opening with a second closure to be assigned to the compartment having a larger air volume above the liquid level. Through a suitable sequence of opening the two closures it is then possible for the fluid displacement effect arising from a unilateral increase or decrease of pressure to be controlled in such a way as to counteract the splashing out of liquid when the container is opened.

For this purpose a particularly advantageous embodiment provides, in the case of a liquid stored under pressure below atmospheric, for the lug and lever to be provided at the first closure because when the vacuum is vented upon opening the first closure the liquid is displaced from the compartment with the smaller air volume above the liquid level into the compartment with a larger air volume above the liquid level. Controlled opening is particularly important when opening containers with pressure below atmospheric because a vigorous opening movement is required to overcome the differential pressure. For a liquid stored under pressure above atmospheric the order of opening is reversed so that the direction of the liquid displacement remains the same. Hence in the second case the lug and the lever are arranged at the second closure.

A particularly comfortable and exactly controllable possibility of opening the container results when a joint is provided in the connecting lug. From the production engineering and cost points of view it is particularly favorable for the joint to be constructed as a film hinge joint.

Further features, advantages and application possibilities of the present invention will become apparent from the subsequent description of an embodiment illustrated in more detail in the accompanying drawings. It will be understood that any single feature described and/or represented by illustration, whether taken alone or in any meaningful combination, form the subject-matter of the present invention, irrespective of their summarization in the claims or their back-references.

BRIEF DESCRIPTION OF DRAWINGS

FIG. 1 shows a container of the invention in the closed state;

FIG. 2 shows the container of the invention in the open state;

FIG. 3 shows a separate representation of a closure for two openings; and

DETAILED DESCRIPTION

Figure 4:
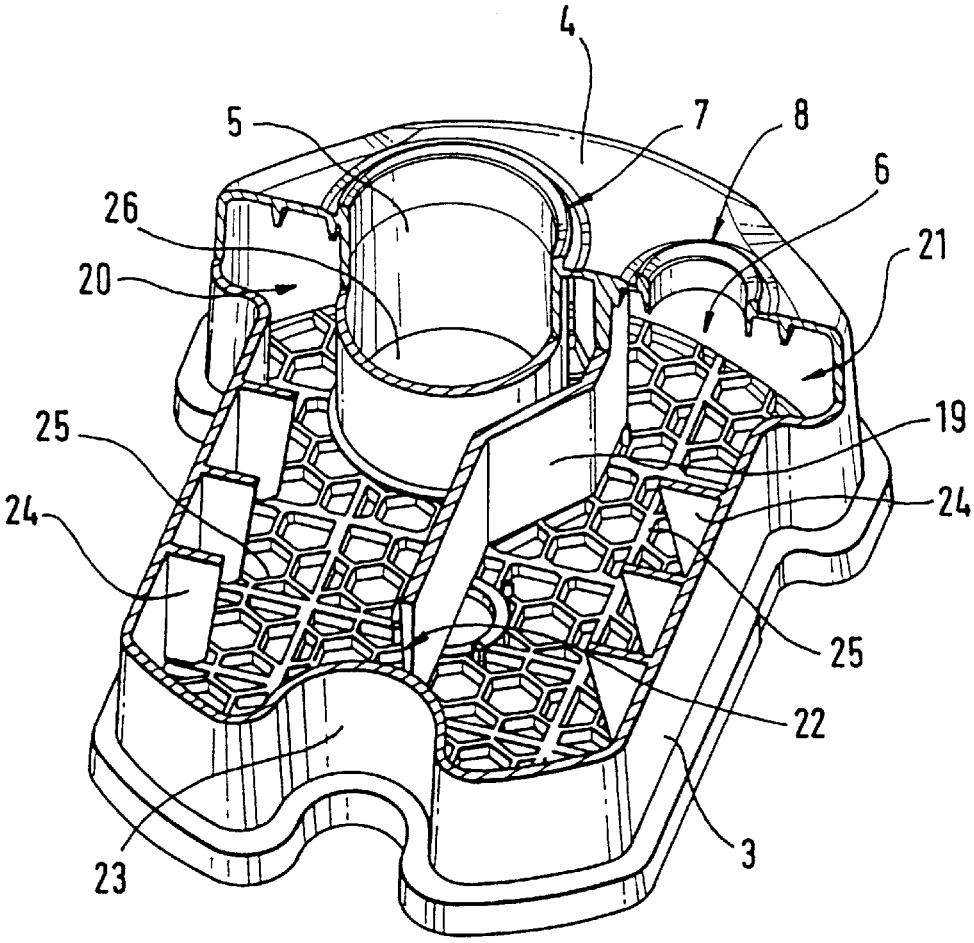
FIG. 4 shows the inner structure of the container.

In the following description the example of a container for cleaning liquid, which is constructed as an replaceable cartridge for a cleaning device for shaving apparatus, will be used to present the invention. The container 1 has a base element 2 whose special construction is shown in detail in FIG. 4. Furthermore, the container is bounded by a circumferential side wall 3 and an upper container wall 4. As can be seen particularly clearly in FIGS. 2 and 4, the upper container wall 4 is equipped with two openings 5, 6 of various size, the pump suction port of the cleaning device being inserted in the first opening of larger cross section while the second opening with the smaller cross section serves to return the cleaning liquid. Both openings 5, 6 have a round cross section which is formed by a tubular wall section 7 and 8, respectively, in the upper container wall.

The tubular wall sections 7, 8 are equipped with ends projecting slightly outwardly so that the closures 9 and 10, which are constructed as so-called ring snap locks, can be securely fastened. In this arrangement the first closure 9 with the larger diameter is associated with the first opening 5, while the second closure 10 is fastened to the tubular wall section 8 of the second opening 6. The two closures 9 and 10 are each constructed such that their outer circumferential edge encompasses the associated tubular wall section 7 and 8, respectively, while a central stopper-like section hermetically sealed by a sealing ring (not shown) fastened to said section projects into the respective tubular wall section 7 and 8. A particularly high sealing force is thus assured and the risk of the closures opening accidentally reduced to a high degree.

As becomes apparent particularly from FIGS. 2 and 3, the two closures 9 and 10 are interconnected by a film hinge 11. To either side of this film hinge 11 are lever arms 12 which extend essentially parallel to the connecting line between the two closures 9 and 10 and are connected to the first closure 9. The free ends of the levers 12 extend toward the second closure 10 and terminate, looking along the connecting line between the two closures, on a level with the area of the second closure 10 facing the first closure 9. Arranged approximately diametrically opposite the film hinge 11 on the first closure 9 is a lug 13 which can be gripped by the user to open the container. Both the lever arms 12 and the lug 13 are equipped with through-holes 14, each of which is associated with a corresponding rivet 15 on the upper container wall 4, which rivet serves as a tamper-proof seal after the container 1 is closed by the closures 9, 10 as by welding or adhesive bonding, for example.

To enable a particularly ergonomic grip for the user the lug 13 is arranged slightly offset to the side in relation to the symmetry axis of the closure looking from above. The lateral offset of the lug 13 improves the self-explanatory handling of the container and the closure because it prompts the user to hold the container in his left hand during the opening operation, with the opening with the larger diameter and the lug 13 pointing away from himself, and to grip the lug 13 between his right thumb and right index finger and initiate the opening operation for the first closure 9 using a type of peeling motion.

FIG. 4 shows a partial section through the upper container wall 4 and a part of the side wall 3. The interior space of the container 1 is divided by a partition wall 19 into a first compartment 20 serving as suction room for the cleaning device and a second compartment 21 serving as the inflow chamber. The two compartments 20 and 21 are interconnected by a single passageway 22 which is formed by a gap between the partition wall 19 and the section 23 of the side wall 3 at the end remote from the openings 5 and 6. The partition wall 19 and the passageway 22 define the flow path which liquid returning from the cleaning device has to take after passing the second opening 6 in order to be drawn up again through the first opening 5. This flow route is constructed as a sedimentation section having ribs 24 and bars 25 where dirt particles dislodged during the cleaning process can settle. In this arrangement the ribs 24 are constructed on the side wall 3, while the bars 25 are arranged in essentially honeycomb form on the base element 2.

As becomes further apparent from FIG. 4, the tubular wall section 8 of the second opening 6 is relatively short in construction because it serves only to receive the second closure 10. By contrast the tubular wall section 7 of the first opening 5 has a length equal to approximately the height of the container 1 because it leads to a filter element 26 resting on the bars 25 and is connected to said filter element in such a way that the filter element 26 covers the entire diameter of the tubular wall section 7. When the container 1 is filled with liquid so that a liquid level develops in the area of the tubular wall section 7, the first opening 5 has a significantly smaller air volume above the liquid level due to the tubular wall section 7 than the second opening 6. When the container liquid is stored under vacuum, as is the case with the replaceable cartridges containing cleaning liquid for cleaning devices for shaving apparatus, it is thus important for the compartment with the smaller air volume above the liquid level to be the first to be opened during the container opening operation. If this compartment is the first to be filled with air from the atmosphere, liquid is allowed to escape from this compartment into the other compartment having the larger air volume above the liquid level. Liquid is thus prevented from splashing out when the closure is opened.

Figure 5:
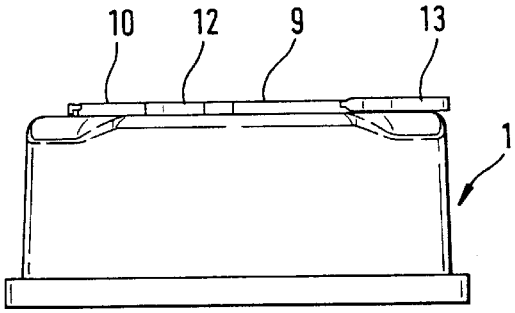
In FIGS. 5 to 9 the opening operation is illustrated by individual phases of the closure opening movement.

FIG. 5 shows an originally closed container 1 on which the two closures 9 and 10 tightly close their respective openings. When the user's hand now applies an opening force (arrow) by pulling the lug 13 upwards, the rivet 15 will be torn off and the first closure 9 will be gradually lifted from the first opening 5. The first closure 9 is opened in conventional manner in particular due to the vacuum in the container and because the risk of spills is still low at this stage.

Figure 6:
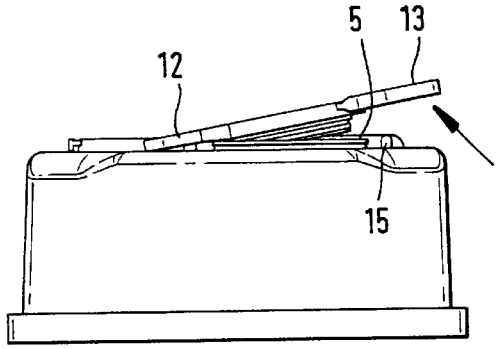

FIG. 6 shows this opening phase in which the free end of the lever arm 12 just comes to rest on the upper container wall 4. At this moment the second closure 10 is still in its initial position closing the second opening 6.

Figure 7:
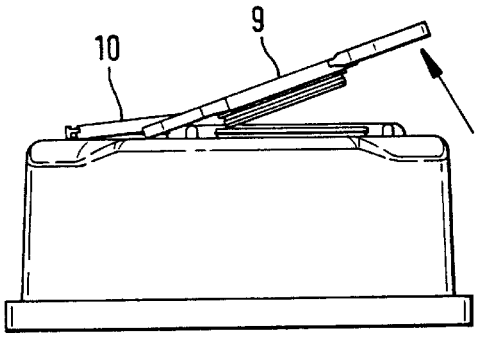
Figure 8:
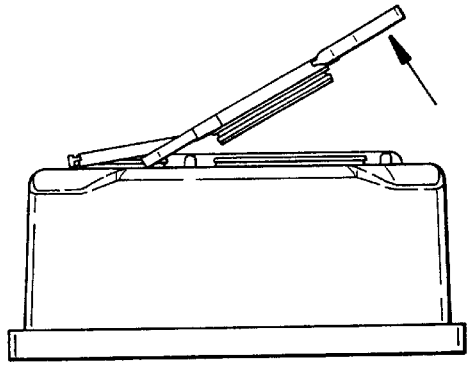
Figure 9:
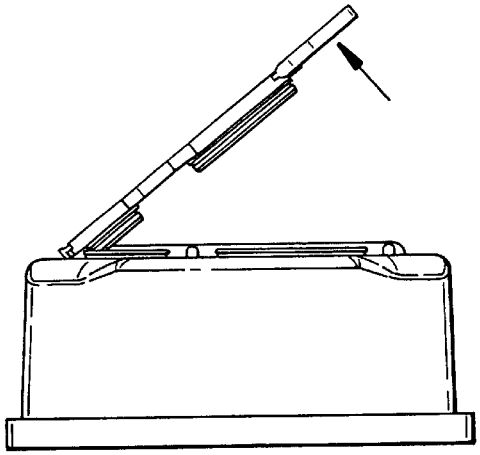

If, as is shown in FIG. 7, the lug 13 is now pulled further upwards, an opening force will be transferred via the film hinge 11 to the second closure 10 dependent on the swiveling motion of the subassembly comprising the lever arm 12, the first closure 9 and the lug 13. In the phase in which the first closure 9 is lifted by approximately 50% from the first opening it starts to turn about the film hinge 11, causing the second closure 10 to be slowly lifted and likewise opened in finely controllable manner by the leverage of the two lever arms 12. The end of the opening movement for the second closure 10, which movement is controlled via the lever arm 12, is presented in FIG. 8. FIG. 9 shows an opening phase in which the second closure 10 is already snapped fully clear of the second opening 6 and the entire closure arrangement is held solely by the user's hand.

The closure arrangement may be re-closed at any time by pressing back onto the openings, for example for transport purposes or for removing from the cleaning device when the cleaning liquid has reached a certain degree of contamination.

Although the closure arrangement was constructed and described with two closures by way of example, it will be understood, of course, that an embodiment with only one closure or with more than two closures is also possible and feasible.

What is claimed is:

1. A liquid container including a container wall defining a first opening and a second opening, and a closure including an outwardly opening first cover portion for covering the first opening, an outwardly opening second cover portion for covering the second opening, a connecting portion connecting the first cover portion and the second cover portion, a graspable lug which when an opening force is applied initially results in outward opening of the first cover portion and then, if sufficient opening force continues to be applied, results in outward opening the second cover portion in a controlled manner, and a lever arm, extending from the first cover portion towards the second cover portion, that bears against the container during opening of the second cover portion.

2. The liquid container of claim 1, wherein the lever arm and the graspable lug each have free ends and the free end of the lever arm extends in the opposite direction of the free end of the graspable lug.

3. The liquid container of claim 1, wherein the connecting portion includes a hinge joint during opening.

4. The container of claim 3, wherein the hinge joint defines an axis of rotation parallel to a pivot axis of the lever arm.

5. The container of claim 1, wherein the first opening and the second opening are of different sizes.

6. The container of claim 1, wherein the container has multiple interior compartments each accessible by the first opening or the second opening.

7. The container of claim 6, wherein the compartments are hydraulically interconnected.

8. The container of claim 7, containing a liquid stored in the interior compartments under a differential pressure relative to the atmosphere, wherein the first opening corresponds to an interior compartment having a relatively smaller air volume above the liquid and the second opening corresponds to an interior compartment having a relatively larger air volume above the liquid.

9. The container of claim 8, wherein the liquid is stored under a pressure below atmosphere.

10. The liquid container of claim 9, wherein the connecting portion includes a hinge joint.

11. The liquid container of claim 3, wherein the hinge joint is a film hinge joint.

12. The container of claim 1, in which the container wall has a rivet extending therefrom and into a hole defined in the closure.

13. The container of claim 12, in which the rivet forms a tamper-proof connection between the container wall and the closure.

14. The container of claim 1, in which the graspable lug is off set from an axis of symmetry of the closure.

15. The container of claim 1, in which the first opening and the second opening are circular, and in which the first cover portion and the second cover portion include a ring snap lock.

* * * * *

UNITED STATES PATENT AND TRADEMARK OFFICE

CERTIFICATE OF CORRECTION

PATENT NO. : 6,637,628 B2
DATED : October 28, 2003
INVENTOR(S) : Jurgen Hoser

It is certified that error appears in the above-identified patent and that said Letters Patent is hereby corrected as shown below:

Title page,
Item [30], Foreign Application Priority Data, delete
"Apr. 15, 2000" and insert -- Jan. 15, 2000 --

Signed and Sealed this

Ninth Day of March, 2004

JON W. DUDAS
*Acting Director of the United States Patent and Trademark Office*